US007388301B2

(12) United States Patent
Komiyama et al.

(10) Patent No.: US 7,388,301 B2
(45) Date of Patent: Jun. 17, 2008

(54) CONSTRUCTION MACHINE

(75) Inventors: Masayuki Komiyama, Hiroshima (JP); Tetsunori Manabe, Hiroshima (JP); Akihito Mino, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 103 days.

(21) Appl. No.: 11/531,971

(22) Filed: Sep. 14, 2006

(65) Prior Publication Data

US 2007/0090650 A1 Apr. 26, 2007

(30) Foreign Application Priority Data

Oct. 12, 2005 (JP) ..... 2005-297895
Oct. 12, 2005 (JP) ..... 2005-297896

(51) Int. Cl.
*F02C 9/00* (2006.01)
*B62D 21/00* (2006.01)

(52) U.S. Cl. ..... 290/40 C; 290/1 A; 180/312

(58) Field of Classification Search ..... 290/1 A, 290/1 B, 2, 40 A, 40 C, 40 F; 180/312, 180/299

See application file for complete search history.

(56) References Cited

U.S. PATENT DOCUMENTS 3,518,444 A * 6/1970 Barber ..... 290/14
4,059,196 A * 11/1977 Uchino et al. ..... 414/699
6,742,619 B2 * 6/2004 Farbotnik et al. ..... 180/312
6,922,990 B2 8/2005 Naruse et al.
7,098,549 B2 * 8/2006 Asakage et al. ..... 290/40 R
7,137,344 B2 * 11/2006 Kumar et al. ..... 105/35
2005/0012337 A1 * 1/2005 Yoshimatsu ..... 290/40 C

FOREIGN PATENT DOCUMENTS

JP 2004-169465 6/2004
JP 3649147 2/2005

* cited by examiner

*Primary Examiner*—Nicholas Ponomarenko
(74) *Attorney, Agent, or Firm*—Oblon, Spivak, McClelland, Maier & Neustadt, P.C.

(57) ABSTRACT

An inverter/converter as a kind of hybrid unit is composed of a body and a casing covering the body and is disposed in an engine room. An air intake port and an air discharge port each provided with a fan are formed in the casing to configure an internal air cooling device for introducing air present outside the engine room into the casing, allowing the air to flow through the interior of the casing and then discharging it from the air discharge port. A power divider for distributing engine power to a hydraulic pump and a generator-motor is disposed on one of right and left sides of an engine in a rear portion of an upper rotating body. Further, an electric power storage device and the inverter/converter are disposed right and left in parallel behind a cabin and in front of the engine, and a partition wall which defines the engine room is configured by casings of the electric power storage device, the inverter/converter and the power divider.

11 Claims, 8 Drawing Sheets

CONSTRUCTION MACHINE

BACKGROUND OF THE INVENTION

1. Field of the Invention

The present invention relates to a construction machine using both engine power and electric power.

2. Description of the Related Art

An excavator shown in FIG. 7 is configured such that an upper rotating body 2 is mounted on a crawler type lower traveling body 1 so as to be rotatable about an axis of ordinate and an excavating apparatus 9 equipped with a boom cylinder 6, an arm cylinder 7 and a bucket cylinder 8 for actuating a boom 3, an arm 4 and a bucket 5 respectively is attached to a front portion of the upper rotating body 2.

A cabin 10 is mounted on a front left side of the upper rotating body 2 and a counterweight 11 is mounted on a rear end portion of the upper rotating body 2.

Behind the cabin 10 is mounted a partition wall 12 in a transverse direction. An engine room 13 is formed between the partition wall 12 and the counterweight 11 and an engine 14 as a power source is installed in the engine room 13 (see Japanese Patent No. 3649147).

FIG. 8 is a block diagram of a drive system and a control system in the case where the excavator in question is configured as a hybrid type.

A variable capacity type hydraulic pump 16 and a generator-motor 17 which in a single unit performs both a generator function and a motor function are connected in parallel to the engine 14 via a power divider (PTO as the case may be) 15 and are driven simultaneously by the engine 14.

The boom, arm and bucket cylinders 6 to 8 shown in FIG. 7, as well as hydraulic actuators such as right and left hydraulic motors for traveling (not shown), are connected to the hydraulic pump 16 via control valves (provided for each actuator, but are here shown as an assembly of plural control valves) 18 and are driven with pressure oil fed from the hydraulic pump 16.

An electric power storage device 20 such as a secondary battery is connected to the generator-motor 17 via an inverter/converter 19.

The inverter/converter 19 not only switches the generator function and the motor function of the generator-motor 17 from one to the other but also controls generated power or an electric current or torque in the motor in accordance with a command issued from a controller 21 and controls the charge and discharge of the electric power storage device 20 in accordance with excess or deficiency of the generator output in the generator-motor 17.

In accordance with the charge quantity in the electric power storage device 20 and the number of revolutions of the generator-motor 17 the controller 21 outputs an engine speed command, a pump volume command for the hydraulic pump 16 and a torque command for the generator-motor 17.

In this configuration, where the power required of the hydraulic pump 16 is large, the generator-motor 17 performs the motor function using the electric power stored in the electric power storage device 20 to make up for the engine output, while where the required power is small, the generator-motor 17 performs the generator function to store electric power in the electric power storage device 20. In this way an energy-saving operation inherent in the hybrid type is performed.

As to the layout of unit in the hybrid type excavator, it is disclosed in Japanese Patent Laid-Open No. 2004-169465.

In the case of a hybrid type excavator it is necessary that hybrid devices such as the generator-motor 17, inverter/converter 19, electric power storage device 20 and controller 21, in addition to engine-related and hydraulic devices (hydraulic pump 16, control valve 18, as well as hydraulic devices including a fuel tank, a working oil tank and a control valve, working oil tank, cooling fan, radiator, oil cooler, etc.), be installed in a space of the same size as a conventional hydraulic excavator.

That is, as many unit as possible must be packed into a limited space.

In this regard, in the conventional excavator, as shown in FIG. 7 and Japanese Patent No. 3649147, a partition wall 12 is provided in a rear portion of the upper rotating body 2 to define an engine room 13 in the rear portion of the upper rotating body 2.

On the right side of the engine room 13 is formed an unit room in which hydraulic devices are mainly installed. The unit room and the engine room 13 are also partitioned from each other using a dedicated partition wall.

Thus, in the conventional hybrid excavator, the dedicated partition wall and the surrounding space are wasteful and this wasteful space narrows an effective volume of the unit mounting space which is originally narrow, making the layout of unit more difficult.

In such a hybrid excavator it is preferable that the inverter/converter 19 as hybrid unit be disposed in the engine room 13 for facilitating electric connection with other hybrid unit (e.g., generator-motor 17) disposed outside the cabin 10 and for ensuring a required internal space of the cabin 10.

In this case, however, a temperature is apt to rise with hot air present in the engine room 13, with a consequent likelihood of malfunction.

According to a known countermeasure to this point, as disclosed in Japanese Patent Laid-Open No. 2004-169465, the inverter/converter 19 is disposed in an intake compartment in the engine room 13 and cooling is performed by utilizing air introduced with a cooling fan which is installed in the intake compartment for air-cooling a radiator and an oil cooler.

On the other hand, in Japanese Patent No. 3649147 there is disclosed a technique such that the electric power storage device 20 is installed behind the cabin 10 and cold air for air conditioning present within the cabin 10 is fed to the rear side of the electric power storage device 20 through a duct disposed through the partition wall 12. It may be effective to apply this technique to the inverter/converter 19.

The body of the inverter/converter 19 is usually accommodated within a box-like casing.

According to the former technique which utilizes air introduced by the cooling fan, the cooling air is brought into contact with an outer surface of the casing and thus the body of the inverter/converter is cooled indirectly via the casing. Therefore, a body cooling effect is not sufficient and an increase in temperature of the body to a high level is unavoidable particularly in the summer season.

On the other hand, according to the latter technique which utilizes cold air present within the cabin, it is necessary that a hole for passage therethrough of the duct be formed in each of the cabin 10 and the partition wall 12, so that not only machining is troublesome and the cost rises, but also the space of the engine room is diminished by the duct piping space for example, with a consequent fear of obstructing the layout of other unit.

SUMMARY OF THE INVENTION

It is an object of the present invention to provide a hybrid type construction machine capable of utilizing the unit mounting space effectively without waste and thereby permitting an efficient layout of unit. It is another object of the present invention to provide a hybrid type construction machine wherein, despite an inverter/converter is installed in an engine room, the body thereof can be cooled effectively by the outside air.

In one aspect of the present invention there is provided a construction machine having the following basic configuration.

That is, a construction machine according to one aspect of the present invention comprises an upper rotating body mounted on a lower traveling body, a cabin mounted on one of right and left sides of a front portion of the upper rotating body, a counterweight disposed in a rear end portion of the upper rotating body, an engine disposed behind the cabin and in front of the counterweight, the engine being installed in a state in which an output shaft thereof faces in a substantially transverse direction, and hybrid unit. The hybrid unit include a generator-motor for performing a generator function and a motor function, an electric power storage device adapted to be charged by an output of the generator-motor, and an inverter/converter for controlling the operation of the generator-motor and that of the electric power storage device. A power divider for distributing engine power to a hydraulic pump and the generator-motor is disposed on one of right and left sides of the engine, the electric power storage device and the inverter/converter are disposed right and left in parallel behind the cabin and in front of the engine, and an L-shaped partition wall in a plan view which defines an engine room is configured by casings which receive therein the electric power storage device, the inverter/converter, and the power divider, respectively.

Thus, according to the present invention, the electric power storage device and the inverter/converter are disposed right and left in parallel behind the cabin and in front of the engine and an L-shaped partition wall is configured by the casings of the electric power storage device, the inverter/converter, and the power divider, respectively, to define an engine room, so in comparison with the provision of a dedicated partition wall as in the prior art, unit can be accommodated efficiently in a narrow space by utilizing the unit mounting space in the upper rotating body without waste.

Moreover, since the electric power storage device and the inverter/converter are disposed right and left in parallel, wiring between the two can be made shortest and hence not only the wiring work becomes easier but also it is possible to diminish the space required for the wiring and thereby enhance the degree of freedom in the layout of unit.

In this case, in the invention of claim 2, the hydraulic pump and the generator-motor are connected in parallel to the power divider outside the engine room, and in the invention of claim 3, hydraulic devices including a hydraulic devices including a fuel tank, a working oil tank and a control valve, a working oil tank and a control valve are disposed outside the engine room. Therefore, the hydraulic pump and the generator-motor, or the hydraulic devices, can be thermally isolated from the engine by the power divider and hence it is possible to avoid a bad influence caused by engine heat.

It is preferable that an intake compartment for intake of outside air by a cooling fan be formed on the side opposite to the power divider in the engine room and that the electric power storage device be disposed so as to face the intake compartment.

In this case, the electric power storage device which is influenced by heat can be cooled with the outside air.

It is preferable that the electric power storage device be disposed on the side (low temperature side) closer to a side face of the upper rotating body which is in contact with the outside air.

In this case it is possible to further enhance the cooling effect. Further, by forming a maintenance port in the side face of the upper rotating body at the position of the electric power storage device, the maintenance of the electric power storage device and the work for replacing the same work become easier.

It is preferable that the interior of the cabin and the interior of the casing of the electric power storage device be connected with each other through a duct to conduct the air present within the cabin as cooling or heating air to the electric power storage device.

In this case, the interior of the electric power storage device can be cooled or heated to an equal extent to the interior of the cabin with cold or hot air present within the cabin. Consequently, the deterioration of performance caused by the heat of the electric power storage device can be prevented more positively.

In another aspect of the present invention there is provided a construction machine having the following basic configuration.

That is, a construction machine according to another aspect of the present invention comprises an upper rotating body mounted on a lower traveling body, an engine installed in an engine room formed in a rear portion of the upper rotating body, and hybrid unit mounted on the upper rotating body. The hybrid unit includes a generator-motor driven by the engine, an electric power storage device adapted to be charged by an output of the generator-motor, and an inverter/converter for controlling the operation of the generator-motor and the electric power storage device. The inverter/converter comprises an inverter/converter body and a casing covering the body and is disposed within the engine room. An air intake port, an air discharge port, and at least one fan, are provided in the casing to configure an internal air cooling device for introducing air present outside the engine room into the casing, allowing the air to flow through the interior of the casing and then discharging it from the air discharge port.

According to this configuration, the air present outside the engine room is introduced into the casing of the inverter/converter installed in the engine room to cool the body of the inverter/converter, in other words, there is adopted a direct internal air-cooling method wherein the inverter/converter body is cooled directly with fresh outside air used exclusively for the inverter/converter by using the casing as a duct. Therefore, the body cooling effect can be greatly enhanced in comparison with the prior art adopting an indirect external air-cooling method wherein the body is cooled indirectly from the outside of the casing by utilizing air introduced with a cooling fan originally installed in the intake compartment.

Further, it is not necessary to form a duct hole in the cabin, etc. unlike the case where the cold air present within the cabin is utilized, nor is there any fear that the engine room space may be diminished by the duct piping space, etc.

That is, despite the inverter/converter is installed in the engine room, there is obtained a cooling effect sufficient to maintain the performance of the inverter/converter even in the summer season. Besides, there accrues an advantage in point of both cost and space.

DESCRIPTION OF THE PREFERRED EMBODIMENTS

Embodiments of the present invention will be described hereinunder with reference to FIGS. 1 to 6.

Figure 7:
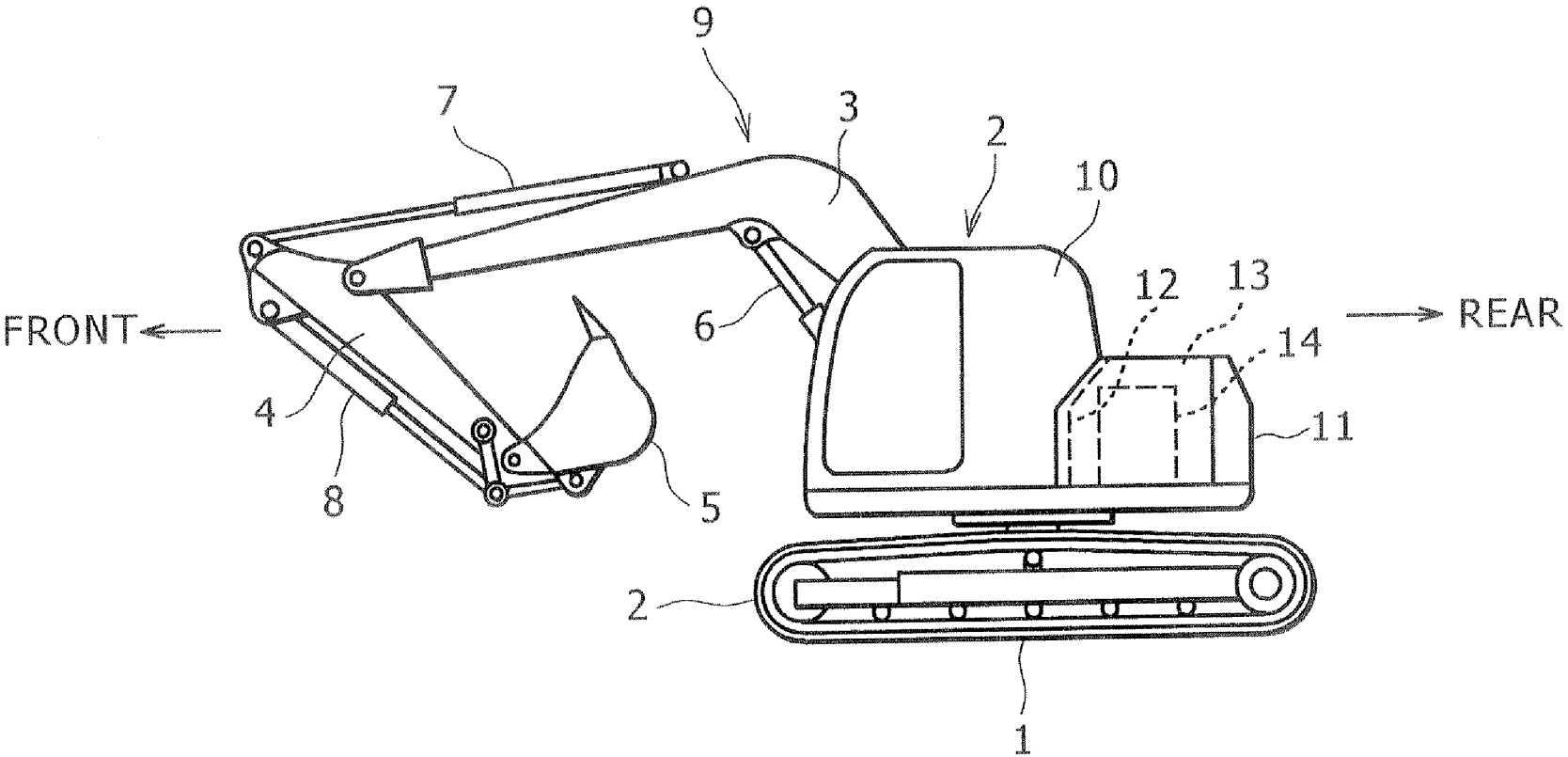
FIG. 7 is a side view showing a general configuration of an excavator.
Figure 8:
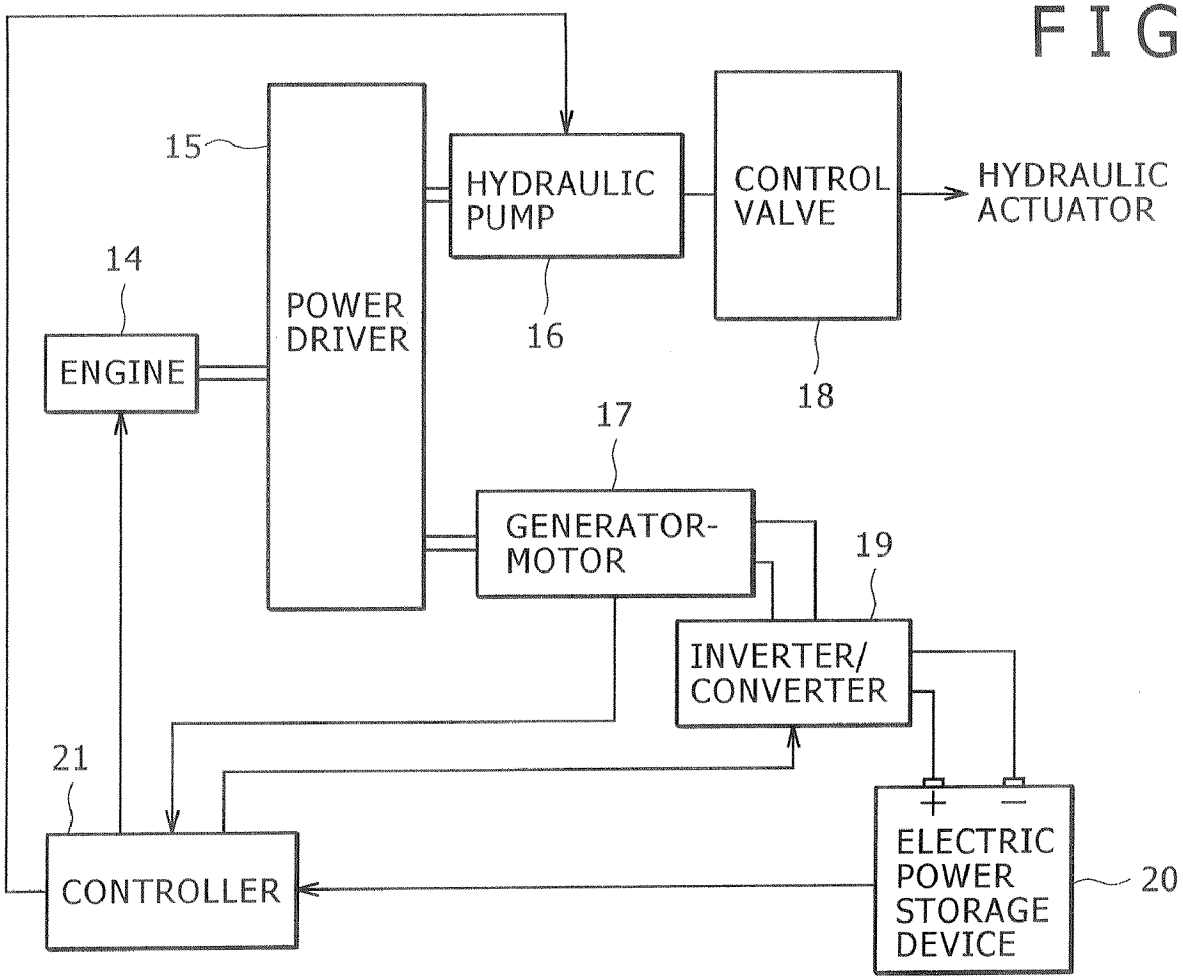
FIG. 8 is a block diagram of a drive system and a control system in case of configuring an excavator as a hybrid type excavator.

In the following embodiments, the same portions as in FIGS. 7 and 8 will be identified by the same reference numerals as in those figures and tautological explanations thereof will be omitted.

Figure 1:
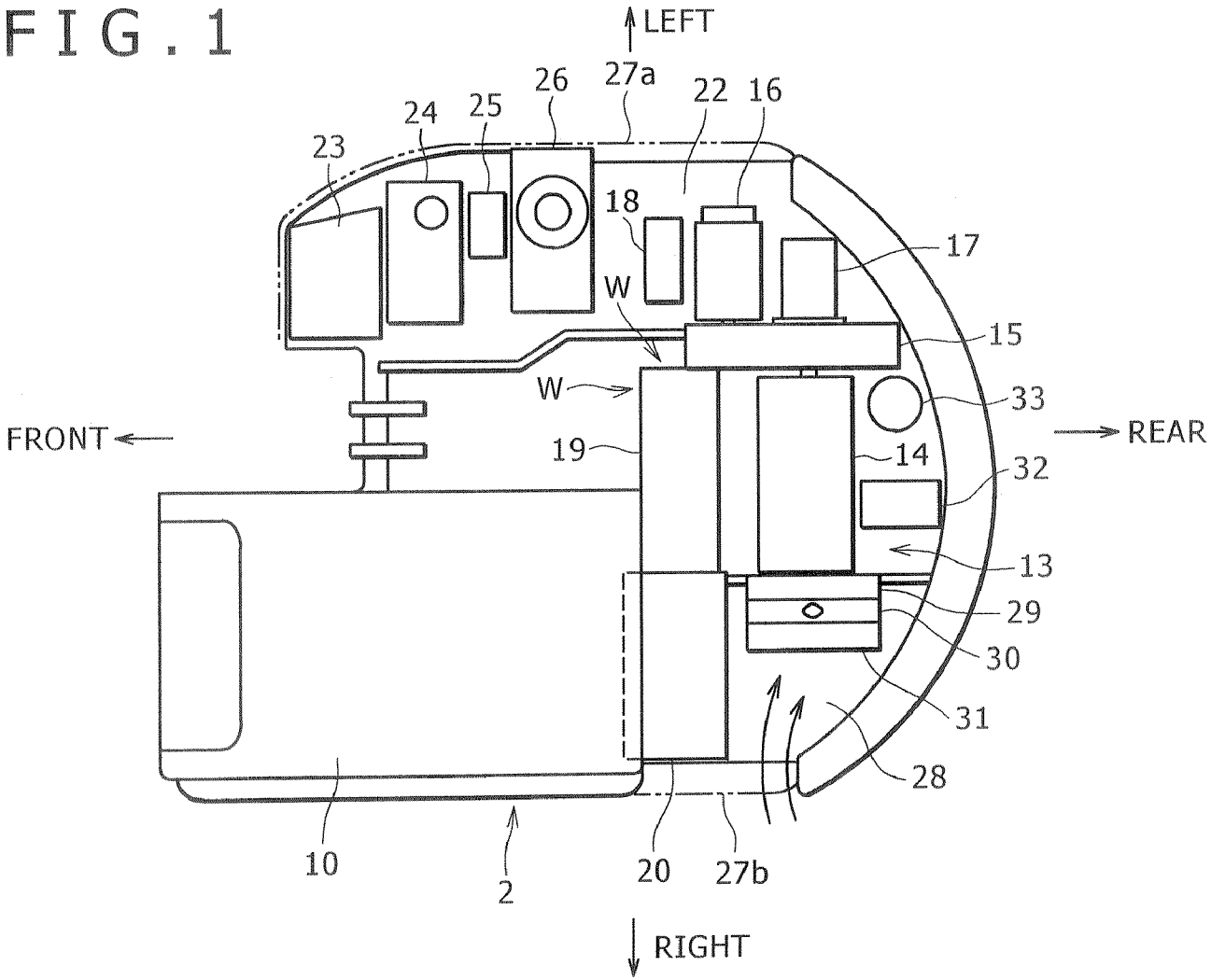
FIG. 1 is a plan view showing a layout of unit in an upper rotating body in an excavator according to an embodiment of the present invention.

FIG. 1 is a top view of a layout of unit in an upper rotating body 2.

An engine 14 is installed in a rear portion of the upper rotating body 2. In front of the engine 14 and behind a cabin 10 there are disposed side by side an electric power storage device 20 on the left side (left side as seen from an operator side sitting on a seat within the cabin 10; this is also true of the directionality of right, left and front, rear which will be referred to below) and an inverter/converter 19 on the right side with little gap between the two.

On the right side of the engine 14 is disposed a power divider 15 for distributing engine power to both a hydraulic pump 16 and a generator-motor 17.

The power divider 15 is disposed in a state in which its rear end portion is close to an inner surface of a counterweight 11 and its front end portion is in abutment against the right side face of the inverter/converter 19.

An L-shaped partition wall W is configured by casings (all are boxes substantially in the shape of a rectangular parallelepiped, with reference numerals thereof not shown in FIG. 1) of the power divider 15, inverter/converter 19 and electric power storage device 20 and an engine room 13 is defined in the rear portion of the upper rotating body 2 as a space enclosed by the partition wall W and the counterweight 11.

An unit room 22 is formed in the whole area on the right side of the upper rotating body 2 including the right side of the engine room 13. Further, in a rear portion of the unit room 22, a hydraulic pump 16 and a generator-motor 17 are connected in parallel to the power divider 15.

In the unit room 22 there are disposed, in order from the front side, an electric power storage device 23 for auxiliary devices, hydraulic devices including a fuel tank, a working oil tank and a control valve 24, a DC/DC converter 25, a working oil tank 26, and a control valve 18.

The right side face of the unit room 22 and the left side face of the engine room 13 are covered with guard members 27*a* and 27*b*, respectively, which are indicated by dash-double dot lines in FIG. 1.

An intake compartment 28 as a part of the engine room 13 is formed on the left side of the engine 14 and in the intake compartment 28 there are disposed a cooling fan 29 which introduces the outside air as indicated by arrows in FIG. 1, as well as a radiator 30 and an oil cooler 31 which are cooled by the introduced outside air.

In FIG. 1, reference numeral 32 denotes a compressor disposed behind the engine 14 in the engine room 13 and reference numeral 33 denotes an engine muffler.

Figure 2:
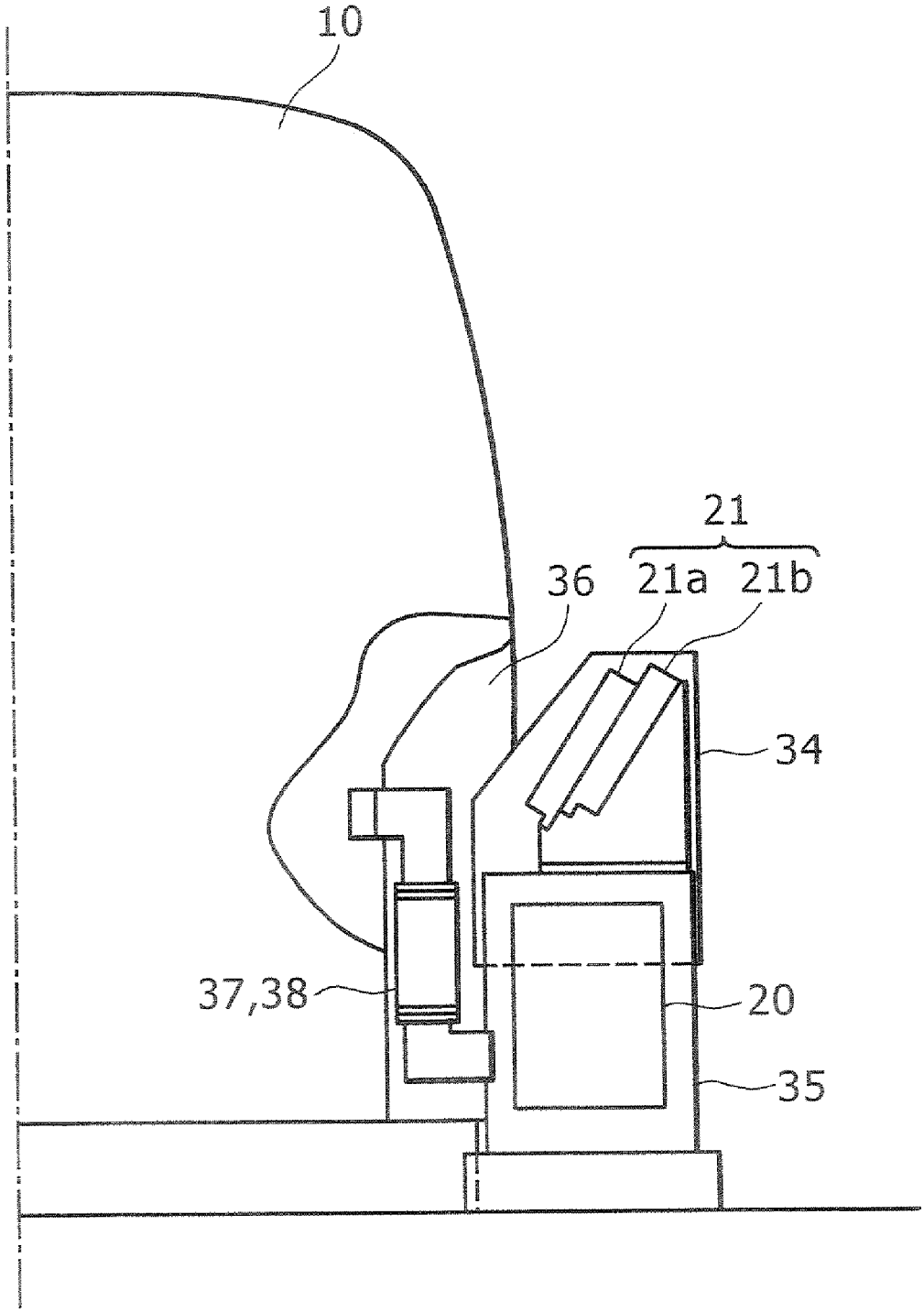
FIG. 2 is a side view showing a part of the excavator of FIG. 1 in an enlarged and partially cut-open state.
Figure 3:
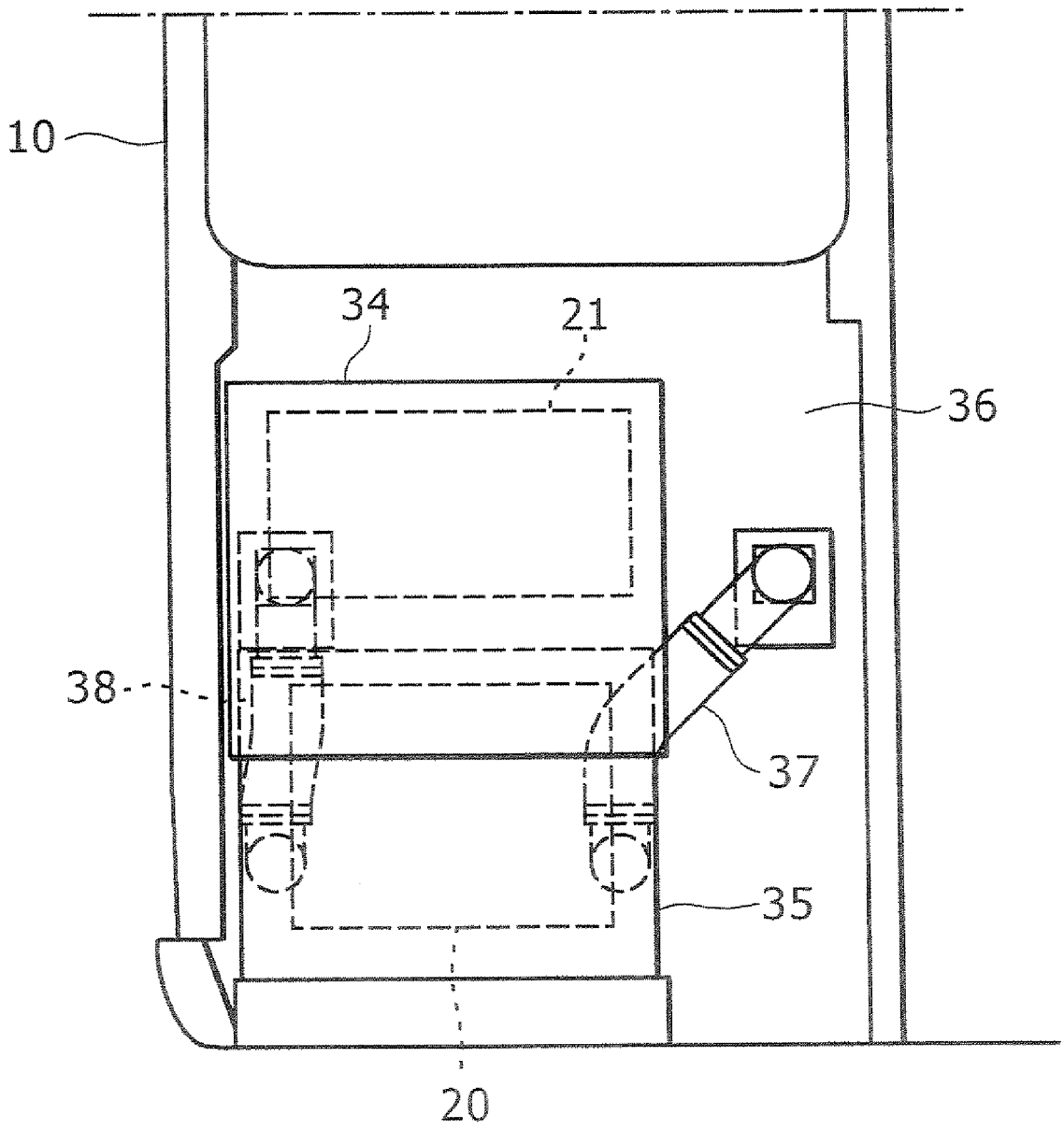
FIG. 3 is a rear view of the part shown in FIG. 2.

On the other hand, as shown in FIGS. 2 and 3, a controller 21 (not shown in FIG. 1 for simplification) is disposed above the electric power storage device 20.

For reducing the overall height, the controller 21 is accommodated within a casing 34 in a rearwards inclined attitude as shown in the figure and is stacked on a casing 35 of the electric power storage device 20.

Precisely, as shown in FIG. 2, the controller 21 is made up of a hybrid control portion 21*a* and a hydraulic control portion 21*b*, which are accommodated within the casing 34 in a front-rear overlapped state.

Further, as shown in FIG. 2, a recess 36 which is depressed to the front side is formed in a lower portion of a rear side of the cabin 10. The electric power storage device 20 and the controller 21 are disposed behind the cabin in a state in which the respective casings 35 and 34 are partially fitted in the recess 36.

Thus, the inverter/converter 19 and the electric power storage device 20 are disposed right and left in parallel behind the cabin 10 and in front of the engine 14 and the L-shaped partition wall W is configured by the casings of the inverter/converter 19, electric power storage device 20 and power divider 15 to define the engine room 13. Therefore, as compared with the conventional provision of a dedicated partition wall, it is possible to eliminate the wasteful use of the partition wall mounting space and the surrounding space and hence possible to effectively utilize the unit mounting space in the upper rotating body 2. That is, many unit can be received efficiently in a limited space.

Moreover, since the electric power storage device 20 and the inverter/converter 19 are disposed right and left, the wiring between the two can be made shortest. Consequently, not only the wiring work becomes simpler but also it is possible to diminish the space required for the wiring and thereby enhance the degree of freedom in the layout of unit.

On the other hand, the hydraulic pump 16 and the generator-motor 17 are connected in parallel to the power divider 15 in the unit room 22 which is located outside the engine room 13, and hydraulic devices including the fuel tank 24, the working oil tank 25 and the control valve 18 are disposed within the unit room 22. Consequently, these unit can be thermally isolated from the engine 14 by the power divider 15 and hence can be prevented from being badly influenced by engine heat. Besides, since hydraulic devices, including the hydraulic pump 16, working oil tank 25 and control valve 18, are disposed all together, it is possible to shorten the hydraulic piping and diminish the pressure loss in the piping.

Further, since the electric power storage device 20 is disposed so as to face the intake compartment 28, the electric power storage device whose performance is deteriorated with heat can be cooled with the outside air.

In this case, as illustrated in the drawing, the electric power storage device 20 is disposed on the left side, i.e., on the side (low temperature side) closer to the side face of the upper rotating body which side face is in contact with the outside air, so that the cooling effect can be further enhanced. Further, by forming a maintenance port in the left guard member 27*b* at a position facing the electric power storage device 20, the maintenance of the electric power storage device 20 and the work for replacement thereof become easier.

Moreover, the controller 21 is disposed outside the cabin 10 and in a stacked fashion on the electric power storage device 20, so in comparison with the conventional case where the controller 21 is installed in the interior of the cabin 10, the controller 21 can be electrically connected outside the cabin 10 to the electric power storage device 20 and the generator-motor 17. Thus, the work for the connection becomes easier.

As noted earlier, the electric power storage device 20 is air-cooled by being disposed so as to face the intake compartment 28. In this regard, in this embodiment there is adopted a configuration wherein cooling or heating air present within the cabin 10 is utilized for the purpose of attaining a higher air-conditioning effect.

This configuration will now be described with reference to FIGS. 2 and 3. A suction duct 37 and a discharge duct 38 are disposed outside the rear surface (recess 36) of the cabin 10.

The suction duct 37 and the discharge duct 38 are disposed on the right side and the left side, respectively, of the cabin 10 in a state in which respective one end portions are in communication with the interior of the cabin 10 and respective opposite end portions are in communication with the interior of the casing 35 of the electric power storage device 20. Suction and discharge fans (not shown) are disposed respectively on the cabin-side end portions of the duct 37 and 38.

In this way cold or hot air present within the cabin 10 is introduced into the casing 35 of the electric power storage device 20 through the suction duct 37, then passes throughout the interior of the casing 35 from the right to the left end, thereafter flows out from the left end, passes through the discharge duct 38 and returns to the interior of the cabin 10.

With this forced air-conditioning system, it is possible to maintain the temperature condition of the electric power storage device 20 equal to that of the interior of the cabin 10 and prevent the deterioration of performance caused by overheating particularly in the summer season or supercooling particularly in the winter season.

There may be adopted a configuration wherein opening/closing valves are mounted in the ducts 37 and 38 respectively to cut off the flowing of air with respect to the interior of the cabin 10 when a cooling or heating operation for the electric power storage device 20 is not necessary.

The present invention is also applicable to a modified excavator with a clamshell type bucket attached thereto, or a machine equipped with a chucking type or vibration type crusher instead of the bucket 5 as an application example of excavator, or a machine using an expansion arm.

The following description is now provided about another embodiment of the present invention, i.e., a hybrid type construction machine wherein although an inverter/converter is installed in an engine room the body thereof can be cooled effectively with outside air. Descriptions of portions which overlap the above embodiment will be omitted.

Figure 4:
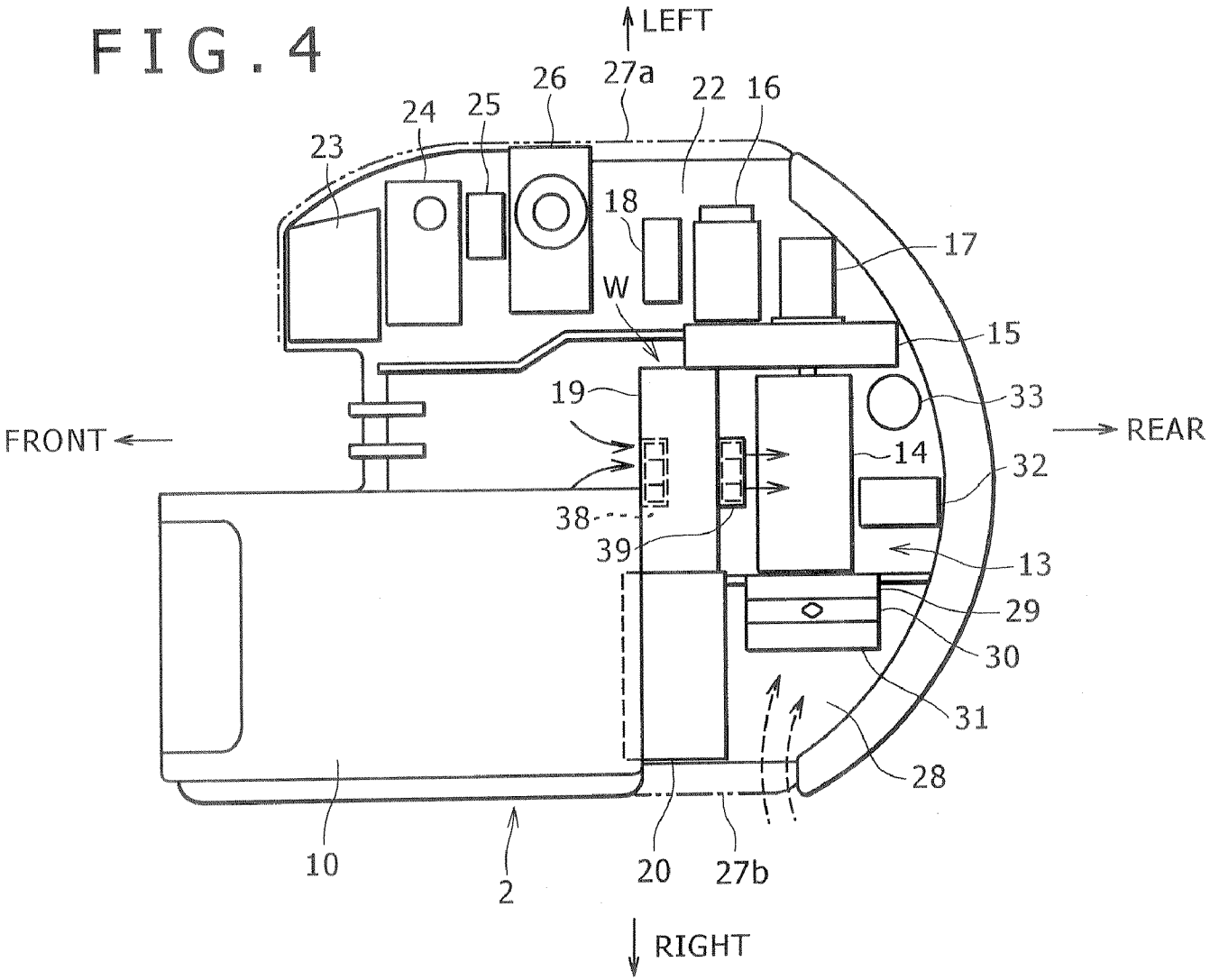
FIG. 4 is a plan view showing a layout of unit in an upper rotating body in an excavator according to another embodiment of the present invention.

According to the layout of unit shown in FIG. 4, in comparison with the conventional case where a dedicated partition wall is provided, it is possible to eliminate the partition wall mounting space and the surrounding wasteful space and thereby effectively utilize the unit mounting space in the upper rotating body 2.

That is, many unit can be accommodated in a limited space efficiently.

An unit room 22 is formed throughout the whole area on the right side of the upper rotating body 2 including the right side of engine room 13, and in the rear portion of the unit room 22 a hydraulic pump 16 and a generator-motor 17 are connected in parallel to a power divider 15.

In the unit room 22 there are disposed, in order from the front side, an electric power storage device 23 for auxiliary devices, a fuel tank 24, a DC/DC converter 25, a control valve 18, and a working oil tank 26.

According to this layout, unit such as the hydraulic pump 16, generator-motor 17, fuel tank 24, working oil tank 26 and control valve 18 can be thermally isolated from an engine 14 by the power divider 15 and it is possible to avoid a bad influence caused by engine heat.

Moreover, since hydraulic devices such as the hydraulic pump 16, working oil tank 25 and control valve 18 are disposed all together, it is possible to shorten the hydraulic piping and thereby diminish the pressure loss in the piping.

The right side face of the unit room 22 and the left side face of the engine room 13 are covered with guard members 27*a* and 27*b*, respectively, which are indicated by dash-double dot lines in FIG. 4.

An intake compartment 28 as a part of the engine room 13 is formed on the left side of the engine 14, and a cooling fan 29 for sucking in the outside air as indicated by broken-line arrows in FIG. 4, as well as a radiator 30 and an oil cooler 31 which are cooled by the outside air thus sucked in, are installed within the intake compartment 28.

In FIG. 4, reference numeral 32 denotes a compressor disposed behind the engine 14 in the engine room 13 and reference numeral 33 denotes an engine muffler.

The electric power storage device 20 is disposed so as to face the intake compartment 28 and on the left side as shown in the drawing, i.e., on the side (low temperature side) closer to the side face of the upper rotating body which is in contact with the outside air. With this arrangement, the electric power storage device 20 can be cooled with the outside air. Besides, the cooling effect can be enhanced to a greater extent than in case of disposing the electric power storage device on the right side.

Figure 5:
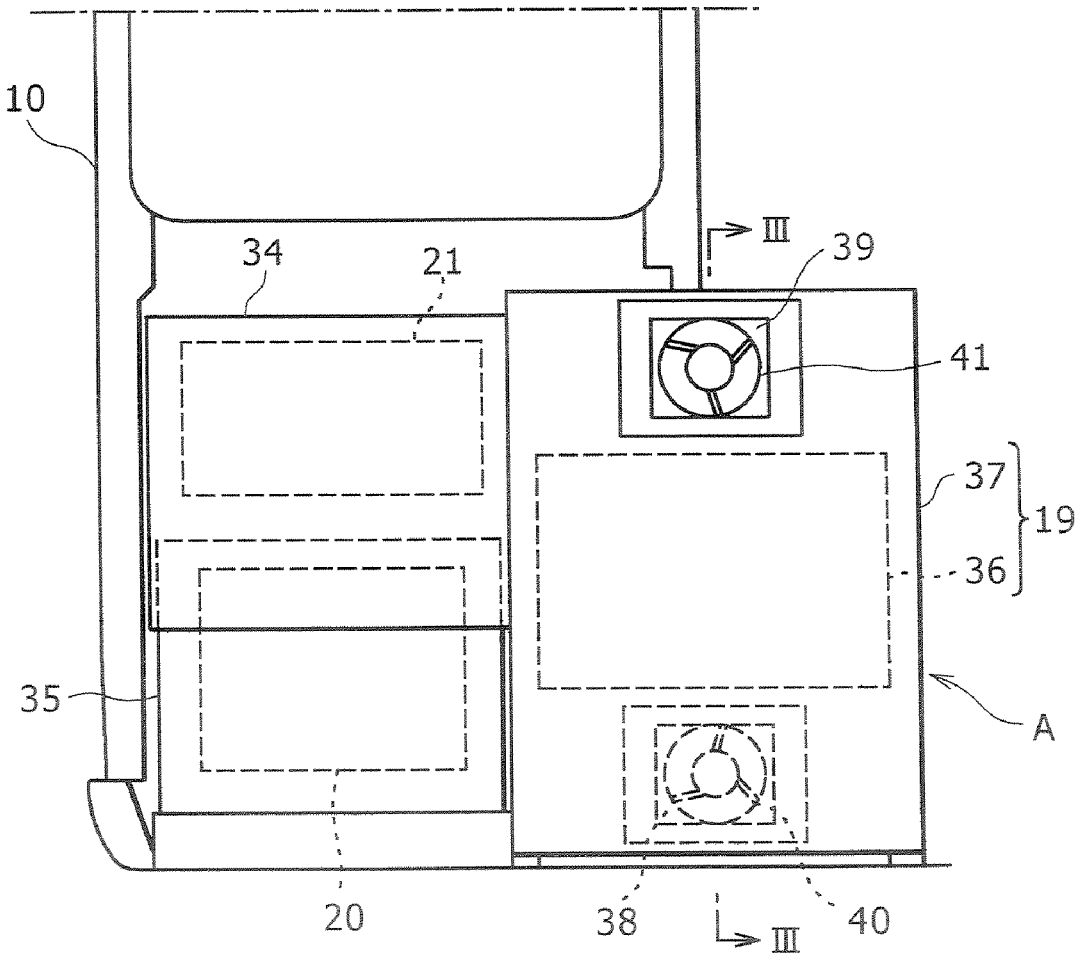
FIG. 5 is a partially enlarged rear view of FIG. 4.

Moreover, as shown in FIG. 5, a controller 21 is disposed in a stacked fashion over the electric power storage device 20 as is the case with FIG. 2 (this is not shown in FIG. 4 for the purpose of simplification). According to this arrangement, in comparison with the case where the controller 21 is installed within the cabin 10, the controller 21 can be connected to the electric power storage device 20, the generator-motor 17, etc. electrically and outside the cabin 10. Consequently, the work for the connection becomes easier.

In FIG. 5, reference numeral 34 denotes a casing which covers the controller 21 and reference numeral 35 denotes a casing which covers the electric power storage device 20.

Next, a description will be given below about the configuration for cooling the inverter/converter 19.

Figure 6:
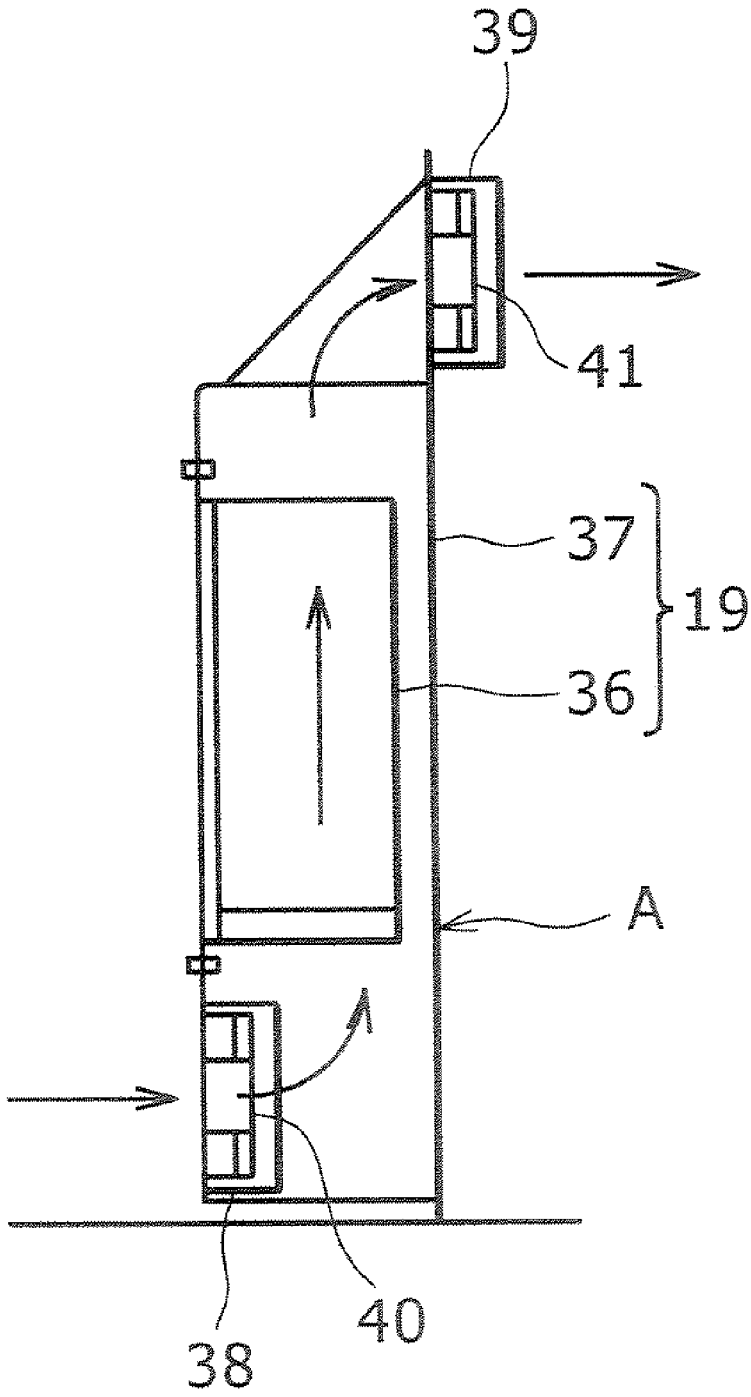
FIG. 6 is a sectional view taken on line III-III in FIG. 5.

As shown in FIGS. 5 and 6, the inverter/converter 19 is made up of a body 36 and a casing 37 as a box of a rectangular parallelepiped which covers the body 36.

An air intake port 38 is formed centrally in a transverse direction of a front lower portion of the casing 37, while an air discharge port 39 is formed centrally in the transverse direction of a rear upper portion as an opposite side of the casing 37, the ports 38 and 39 being formed so as to open to the exterior of the casing. Further, an intake fan 40 and an exhaust fan 41 are provided in the air intake port 38 and the air discharge port 39, respectively.

Thus, an internal air cooling system A is configured such that fresh outside air is introduced through the casing 37, air intake port 38, air discharge port 39 and both intake and exhaust fans 40, 41 with using the casing 37 as a duct and is brought into direct contact with the body 36 to cool the body.

In this configuration, when both intake and exhaust fans 40, 41 are rotated, fresh outside air present outside the engine room is introduced into the air intake port 38 from the front side as indicated with arrows in FIGS. 4 and 6, then flows upward through the interior of the casing 37 (the gap between a peripheral wall of the casing and the body 36) and is thereafter discharged to the engine room 13 from the air discharge port 39.

Thus, not only the body 36 is cooled indirectly from the outside of the casing 37 by utilizing the air introduced with the cooling fan 29 but also there is adopted a direct internal air-cooling method wherein the body 36 is cooled directly with fresh outside air exclusive for the inverter/converter 19. Consequently, the cooling effect can be enhanced remarkably in comparison with adopting an indirect external cooling method wherein the body 36 is cooled indirectly from the outside of the casing 37 by utilizing the air introduced by the cooling fan 29 which is mounted originally in the intake compartment 28.

Besides, there is neither the need for forming a duct hole in the cabin 10 etc. as in case of utilizing cold air present within the cabin nor a fear of the engine room space being diminished by the duct piping space, etc.

That is, while the inverter/converter 19 is installed in the engine room, a satisfactory cooling effect for maintaining the performance of the inverter/converter is obtained even in the summer season; besides, there accrues an advantage in point of cost and space.

Moreover, since the outside air is introduced from the opposite side of the engine 14, it is possible to introduce more fresh and low temperature outside air not influenced by the heat of the engine room.

Further, since the air discharge port 39 is formed on the side opposite vertically and longitudinally (rear upper portion) to the air intake port 38, the introduced air easily spreads over the whole area in the interior of the casing. As a result, it is possible to enhance the cooling efficiency of the body 36.

Additionally, since the casing 37 of the inverter/converter 19 is configured as a part of the partition wall W which forms the engine room 13, an extra work such as forming an air intake hole in a dedicated partition wall is no longer required, thus making it possible to reduce the cost.

Further Embodiments (1) The air intake port 38 may be formed on one of right and left sides of the front face of the casing and the air discharge port 39 may be formed in the rear face of the casing on the side transversely opposite to the air intake port 38. Alternatively, the air intake port 38 and the air discharge port 39 may be formed in opposite side faces of the casing 37 when there is a space outside each of the side faces.

(2) Although both intake and exhaust fans 40, 41 are provided in the above second embodiment, one of the fans may be omitted.

(3) Although in the above second embodiment the casing 37 of the inverter/converter 19 is configured as a part of the partition wall W which defines the engine room 13, the present invention is also applicable to the case where the engine room 13 is partitioned using a dedicated partition wall. In this configuration, if the partition wall is positioned on the air intake side, it is necessary to form an air intake hole in the partition wall.

(4) The present invention is also applicable to a modified excavator with a clamshell bucket attached thereto, a machine with a chucking type or vibration type crusher attached thereto instead of the bucket 5 as an application example of excavator, or a machine using an expansion arm.

Although the invention has been described with reference to the preferred embodiments in the attached figures, it is noted that equivalents may be employed and substitutions made herein without departing from the scope of the invention as recited in the claims.

We claim:

1. A construction machine comprising:

a lower traveling body;

an upper rotating body mounted on said lower traveling body;

a cabin mounted on one of right and left sides of a front portion of said upper rotating body;

a counterweight disposed in a rear end portion of said upper rotating body;

an engine disposed behind said cabin and in front of said counterweight, said engine being installed in a state in which an output shaft thereof faces in a substantially transverse direction; and a hybrid unit, said hybrid unit including:

a generator-motor for performing a generator function and a motor function;

an electric power storage device adapted to be charged by an output of said generator-motor; and an inverter/converter for controlling the operation of said generator-motor and that of said electric power storage device, wherein a power divider for distributing engine power to a hydraulic pump and said generator-motor is disposed on one of right and left sides of said engine, said electric power storage device and said inverter/converter are disposed right and left in parallel behind said cabin and in front of said engine, and an L-shaped partition wall in a plan view which defines an engine room is configured by casings which receive therein said electric power storage device, said inverter/converter, and said power divider, respectively.

2. The construction machine according to claim 1, wherein said hydraulic pump and said generator-motor are connected in parallel to said power divider outside said engine room.

3. The construction machine according to claim 1, wherein hydraulic devices including a fuel tank, a working oil tank and a control valve are disposed outside said engine room.

4. The construction machine according to claim 1, wherein an intake compartment for intake of outside air by a cooling fan is formed on the side opposite to the power divider in said engine room, and said electric power storage device is disposed so as to face said intake compartment.

5. The construction machine according to claim 1, wherein said electric power storage device is disposed on the side closer to a side face of said upper rotating body out of the right and left sides.

6. The construction machine according to claim 1, wherein the interior of said cabin and the interior of the casing of said electric power storage device are connected with each other through a duct to conduct the air present within the cabin as cooling or heating air to the electric power storage device.

7. The construction machine according to claim 1, wherein a controller for controlling said hybrid unit is disposed in a stacked fashion on said electric power storage device.

8. A construction machine comprising:

a lower traveling body;

an upper rotating body mounted on said lower traveling body;

an engine installed in an engine room formed in a rear portion of said upper rotating body; and a hybrid unit mounted on said upper rotating body, said hybrid unit including:

a generator-motor driven by said engine;

an electric power storage device adapted to be charged by an output of said generator-motor; and an inverter/converter for controlling the operation of said generator-motor and said electric power storage device, wherein said inverter/converter comprises an inverter/converter body and a casing covering said body and is disposed within said engine room, an air intake port, an air discharge port, and at least one fan, are provided in said casing to configure an internal air cooling device for introducing air present outside said engine room into the casing, allowing the air to flow through the interior of the casing and then discharging it from said air discharge port.

9. The construction machine according to claim 8, wherein said inverter/converter is disposed in front of said engine in said engine room, and said air intake port is formed in a front lower portion of said casing.

10. The construction machine according to claim 9, wherein said air discharge port is formed in a rear upper portion of said casing.

11. The construction machine according to claim 8, wherein the casing of said inverter/converter is configured as a part of a partition wall which forms said engine room.

* * * * *